United States Patent [19]

Nielsen et al.

[11] Patent Number: 4,708,589

[45] Date of Patent: Nov. 24, 1987

[54] ROLL-FORMED SUBMERSIBLE PUMP

[75] Inventors: Darryl N. Nielsen, Lenexa; Charles F. Wheeler, Olathe, both of Kans.

[73] Assignee: The Marley-Wylain Company, Mission Woods, Kans.

[21] Appl. No.: 910,806

[22] Filed: Sep. 22, 1986

Related U.S. Application Data

[63] Continuation of Ser. No. 778,127, Sep. 19, 1985, abandoned.

[51] Int. Cl.[4] ..... F04D 29/22

[52] U.S. Cl. ..... 415/199.2; 415/219 R

[58] Field of Search ..... 415/198.1, 199.2, 501, 415/140, DIG. 3, 219 R

[56] References Cited

U.S. PATENT DOCUMENTS

| | | | |
|---|---|---|---|
| 2,954,739 | 10/1960 | Lung | 415/501 |
| 3,158,295 | 11/1964 | McConaghy | 415/199.2 |
| 3,238,879 | 3/1966 | Shallenberg | 415/199.2 |
| 3,521,970 | 7/1970 | Deters | 417/424 |
| 3,612,716 | 10/1971 | Deters | 415/140 |
| 3,676,025 | 7/1972 | Schultz | 415/213 T |
| 4,120,606 | 10/1978 | Reiss | 415/500 |
| 4,172,690 | 10/1979 | Kuntz | 415/199.2 |
| 4,406,582 | 9/1983 | LaGrange | 415/501 |

*Primary Examiner*—Robert E. Garrett
*Assistant Examiner*—John T. Kwon
*Attorney, Agent, or Firm*—Schmidt, Johnson, Hovey & Williams

[57] ABSTRACT

A submersible pump has a cartridge of pump stages that are compressed between an inlet base and a discharge head as a pump casing surrounding the cartridge is roll-formed to complementally engage shoulders on the base and the head. The inner diameter of the casing presents a slight interference fit with each of the pump stages so that a diffuser on each stage is held in a stationary position during operation of the pump. The casing also provides a plurality of radially inwardly directed forces to maintain the stages in alignment with each other. Complete circumferential contact of the diffuser walls with the interior surface of the casing reduces interstage leaking such that pump efficiency is enhanced.

6 Claims, 5 Drawing Figures

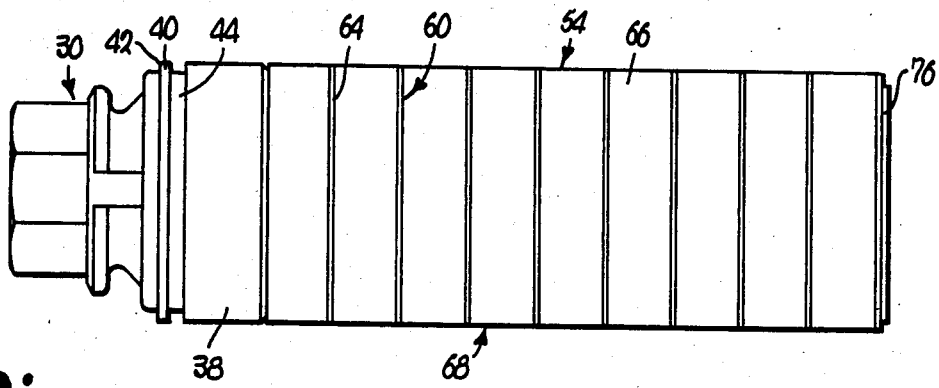
Fig. 3
Fig. 4
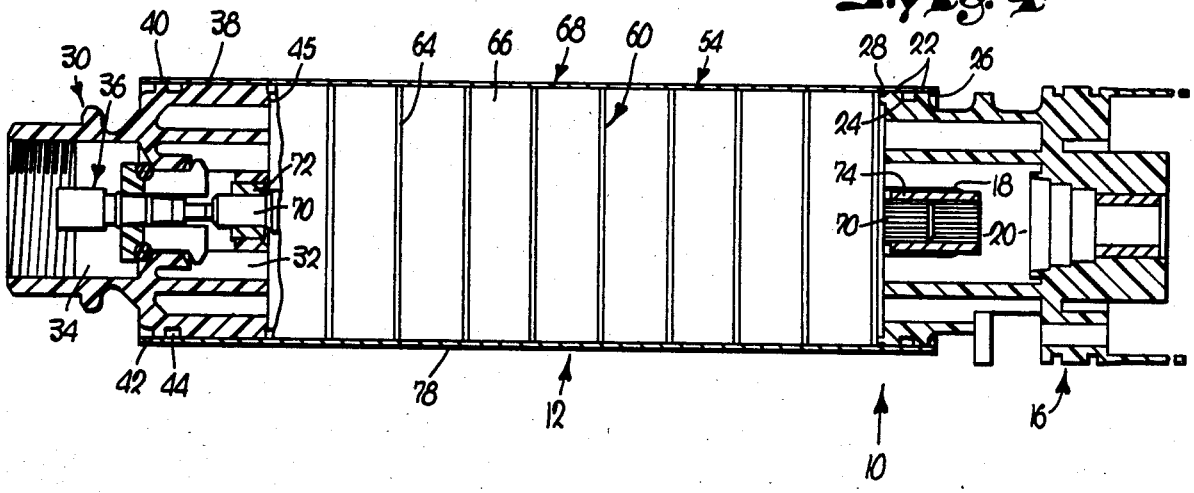
Fig. 5
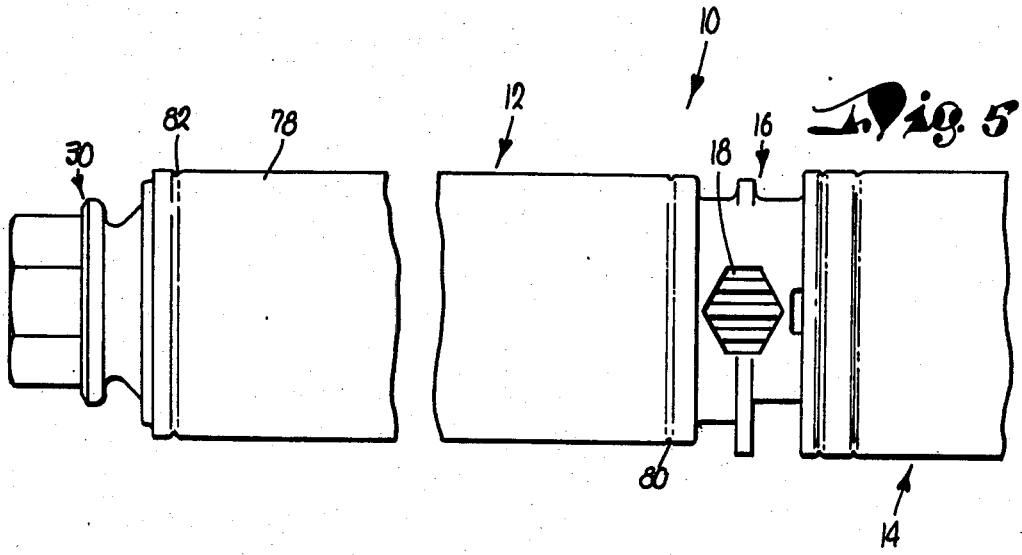

ROLL-FORMED SUBMERSIBLE PUMP

This application is a continuation of application Ser. No. 778,127, filed Sept. 19, 1985, now abandoned.

BACKGROUND OF THE INVENTION

1. Field of the Invention

This invention relates to a submersible pump assembly wherein a plurality of pump stages as well as a discharge head and an inlet base are pressed under pressure into a casing, and the latter is then roll-formed to maintain the discharge head, the stages and the inlet base in assembled, aligned relationship.

2. Description of the Prior Art

Over the years, much effort has been expended toward optimization of pump performance. Desirably, pumps should utilize a minimum of motor horsepower while providing a maximum flow rate and discharge pressure. In addition, submersible pumps are faced with size restrictions due to the diameter of the well pipe. Moreover, access to such submersible pumps is often somewhat difficult and thus these pumps should operate reliably over extended periods without maintenance.

As is known, conventional submersible pumps are comprised of an inlet base, a stack of pumps stages above the base, and a discharge head on the upper end of the stack remote from the base. A casing surrounds the stages and is secured to the head and the base. A drive shaft, coupled to a motor armature, extends axially through the stack and is fixed to an impeller within each of the stages. Rotation of the drive shaft thus turns each impeller to force fluid radially outward toward an adjacent, stationary diffuser, and in turn the cooperating diffuser directs the fluid radially inwardly and upwardly toward the next pump stage.

In the past, certain submersible pumps have been provided with a thin, metallic casing having formed screw threads which are engageable with complemental threads on the discharge head and the base. During assembly, the stages are slipped into the casing and the head and base are then threaded into the casing until engaging respective ends of the staging stack. The diffusers of such pumps are thus held stationary by the axial force exerted on the staging stack by the head and base once the latter are tightened.

Unfortunately, in such prior art pumps, the axial force of the head and base against the staging is sometimes insufficient to preclude movement of the diffusers in a direction laterally of the staging stack. Moreover, such axial forces are occasionally unable to provide sufficient frictional forces to preclude rotation of the diffusers. As a result, efficiency of the pump is reduced substantially and the latter must then be removed from the well, often at great expense, for servicing.

SUMMARY OF THE INVENTION

The instant invention overcomes the disadvantages of the prior art by provision of a novel pump assembly and method for manufacturing the same. It has been found that the instant pump provides increased operational efficiency as well as improved reliability in comparison to known conventional pumps.

In more detail, the base, the stack of pump stages, and the discharge head are pressed under pressure into a complementally configured, thin stainless steel casing, and the casing is then roll-formed at its outer edges to grippingly engage shoulders formed in the base and the head. Each of the pump stages has a diffuser with an outer wall of a diameter to provide an interference fit with the casing, such that the casing thereby provides sufficient frictional forces for retaining the diffusers in a stationary position as the impellers are rotated. Preferably, the diffusers are in the form of a cup surrounding the impeller so that a relatively wide wall is presented to engage the casing.

Moreover, the relatively tight fit of the casing against the stages creates a plurality of equal, radially inwardly directed forces toward the center of each stage such that lateral movement of the latter relative to the longitudinal axis of the stack is generally precluded. As such, the stages are retained in substantial alignment relative to each other whereby overall reliability of the pump assembly is improved.

Additionally, the complete circumferential contact of the casing with each other of the cylindrical diffuser walls substantially precludes leakage of fluid between each of the stages and the casing. Accordingly, overall pump efficiency is greatly enhanced. Also, the complemental fit of the casing with the outer walls of the staging provides "hoop" strength to the relatively thin stainless steel casing. By contrast, prior art pump assemblies having a gap between the casing and the staging walls required the use of somewhat thicker casing in order to resist damage due to denting of the casing or the like.

BRIEF DESCRIPTION OF THE DRAWINGS

FIG. 3 is a side elevational view depicting the next step of assembly wherein a discharge head is positioned over the discharge end of the stack of staging;

FIG. 4 is a side cross-sectional view illustrating the next step of assembly wherein pump casing is pressed over the staging and discharge head as well as an inlet base; and FIG. 5 is a fragmentary, elevational view of the completed pump assembly, wherein the ends of the casing have been roll-formed to complementally engage the discharge head and the base, the latter of which is also secured to a shell of an adjacent electric motor.

DETAILED DESCRIPTION OF THE DRAWINGS

Figure 1:
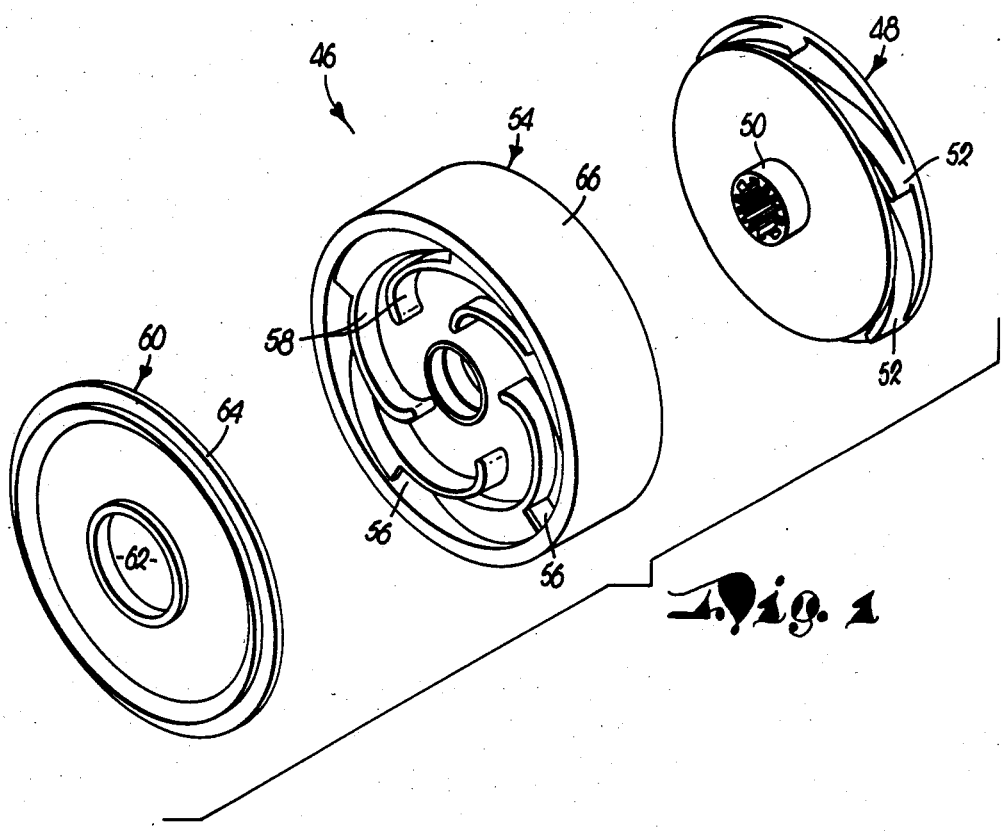
FIG. 1 is an exploded view in perspective of a typical pump stage of the instant invention.

Referring initially to FIGS. 4–5, a submersible well pump 10 includes a pump assembly 12, a motor assembly 14 and an inlet base 16 interconnecting the pump assembly 12 and the motor assembly 14. The base 16 has a slotted intake opening 18 which is operable to enable passage of water from a well into a chamber 20 centrally disposed within the base 16.

The base 16 has a pair of outer cylindrical surfaces 22 that are separated by a groove 24. The inwardmost surface 22 is adjacent a recess to present a shoulder 26 that is aligned with the surfaces 22, 22 as well as a cylindrical, outwardly extending lip 28 on the outer end of the base 16.

The pump assembly 12 also includes a discharge head 30 spaced from the base 16. The head 30 has a cavity 32, an outlet passageway 34 and a check valve assembly 36 which is operable to permit fluid flow only in the direction from the cavity 32 and into the passageway 34. As shown in FIG. 4, the head 30 is internally tapped for threaded engagement with a well pipe (not shown).

As best illustrated in FIGS. 3–4, the discharge head has a relatively wide outer cylindrical surface 38 and a relatively narrow cylindrical surface 40, the latter of which presents an outermost shoulder 42. A groove 44 is disposed intermediate the surfaces 38, 40. Additionally, the discharge head 30 has an outwardly extending lip means or rim 45, the outermost edge of which is concentric and orthogonally oriented relative to the surfaces 36, 38 as well as the shoulder 42.

Reference is now made to FIG. 1, wherein is shown a representative pump stage 46 for the assembly 12. Each of the stages 46 has an impeller 48 with a projecting, notched hub 50. The impeller 48 has a central eye (not shown) on its opposite side, and during rotation of the impeller 48, the eye admits water which is then propelled radially outward by a plurality of curved members 52.

The hub 50 of the impeller 48 is received in a central opening of a generally cup-shaped diffuser 54. The diffuser 54 includes passageways 56 for admission of water that is propelled outwardly from the impeller 48. A plurality of curved vanes 58 direct the water from the passageways 56 inwardly toward the center of the diffuser 54. As is conventional, the cross-sectional areas between the vanes 58 increase as the center of the diffuser 54 is approached so that the velocity head of the water stream is converted into a pressure head.

Each of the stages 46 also includes a generally flat thrust plate 60 having a central opening 62 for passage of fluid from the central areas of the diffuser 54 toward the impeller eye of the next adjacent stage 46. The thrust plate 60 has a relatively narrow outer cylindrical edge 64 of a diameter that is substantially equivalent to a relatively wide, cylindrical wall 66 forming the periphery of the diffuser 54.

Figure 2:
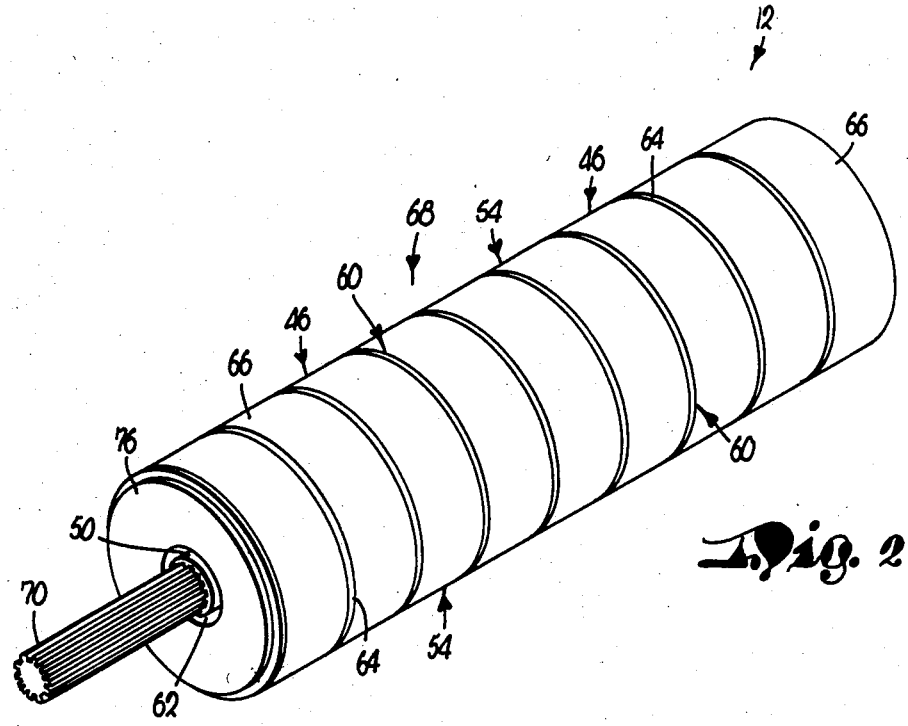
FIG. 2 is a reduced, perspective illustration of an initial step of assembly for the pump of the instant invention wherein the stages are stacked as a cartridge and a drive shaft is inserted within the keyed hub of each impeller.

Viewing FIG. 2, the pump assembly 12 includes an elongated cartridge 68 which is comprised of a plurality of pump stages 46 disposed in stacked relationship. A multi-splined drive shaft 70 is extended through the cartridge 68 for mating engagement with the notched hub 50 of each of the impellers 48.

Referring again to FIG. 4, the cartridge 68 is disposed intermediate the base 16 and the discharge head 30, such that an end portion of the shaft 70 is disposed within a sleeve bearing 72 secured to the head 30. Remote from the bearing 72, the shaft 70 is inserted in a mating coupling 74 for driving connection with a shaft of a motor armature (not shown).

Each of the thrust plates 60 is provided with a circular offset 76 (best seen in FIG. 2) which complementally fits within the adjacent diffuser 54. In the case of the first thrust plate **60*a* in engagement with the discharge head 30 (see FIG. 4) the offset 76 is complementally received within the lip 28. At the opposite side of the cartridge 68, the outermost diffuser 54 communicates directly with the cavity 32 of the discharge head 30**.

A thin, stainless steel casing 78, having a substantially smooth inner surface and a substantially smooth outer surface, surrounds the cartridge 68 and is connected to the base 16 and the head 30. The casing 78 is formed to complementally engage the shoulder 26 on the base 16 as well as the shoulder 42 on the head 30, as illustrated in FIG. 5. Moreover, a pair of circumferentially extending crimped deformations or depressions 80, 82 are formed in the vicinity of the grooves 24, 44 respectively.

Advantageously, the interior diameter of the tubular, cylindrical casing 78 is equivalent to or slightly less than the diameter of the diffuser walls 66, the thrust plate edge 64, the surfaces 22, 22 on the base 16 as well as the surfaces 38, 40 on the head 30. In particular, the diffuser walls 66 are preferably in substantially complete circumferential contact with the casing 78. In one example, the diffuser walls 66 have an external diameter of $3.43 \pm 0.015$ inches, the thrust plate edge 64 has an outer diameter of $3.344 \pm 0.005$ inches, the surfaces 22, 22 have a diameter of 3.337 to 3.343 inches, the surfaces 38, 40 have a diameter of 3.338 to 3.343 inches, while the casing 78, by comparison, has an inner diameter of 3.313 to 3.317 inches before assembly of the pump 10.

In the method of assembling the pump 12, the shaft 70 is inserted centrally through the cartridge 68 and into the mating hubs 50 of each of the impellers 48, as shown in FIG. 2. Next, the discharge head 30 is positioned in aligned relationship to one end of the cartridge 68 (see FIG. 3) and the casing 78 is pressed over the cartridge assembly as well as the surfaces 38, 40 on the head 30.

Viewing FIG. 4, the base 16 is then pressed into one end of the casing 78 until the lip 28 matingly engages the offset 76 on the adjacent thrust plate **60*a*. Subsequently, an axial, inwardly directed force is exerted on both the base 16 and the head 30 so that the cartridge 68 is compressed between the head 30 and the base 16. Simultaneously, the outer end portions of the casing 78 are formed to complementally engage the shoulders 26, 42 as well as the grooves 24, 44**.

The completed pump assembly 12, after forming of the casing 78, is depicted in FIG. 5. Compression of the stages 46 between the base 16 and the head 30 during the forming operation ensures that the casing 78 will thereafter continue to exert opposite, longitudinally extending compressive forces on the stages 16.

The interference fit of the casing 78 with the walls 66 of the diffusers 54 provides sufficient frictional forces for retaining the diffusers 54 in a stationary position as the impellers 48 are rotated. It can be appreciated that the fluid forces of the swirling water stream created by operation of the impellers 48 exerts a substantial rotative force on the vanes 58 of the diffuser 54. However, it has been found that the pressing engagement of the diffuser walls 66 against the casing 78 is sufficient to maintain the diffusers 54 in a stationary position.

Moreover, the interference fit of the cartridge 68 with the casing 78 enables the latter to exert a plurality of equal, radially inwardly directed forces toward the pump stages 46 such that each of the diffusers 54 and thrust plates 60 are retained in substantial alignment relative to each other. Additionally, it has been found that the close, mating fit of the diffuser walls 66 against the casing 78 substantially precludes leakage of water between the stages 46 and the casing 78. Such reduction in interstage leaking thereby increases the overall efficiency of the pump assembly 12.

Consequently, the assembly 12 of the instant invention presents a departure from known prior art pumps. In the past, the pump stages were only loosely retained within the casing, as it was believed that such a loose, sliding fit was necessary to facilitate repairs. As can be appreciated, the casing of such pumps is thus not operable to retain the stages in alignment nor to support the diffusers in a stationary position. Instead, the base and the head were often tightly threaded into the pump casing so that only longitudinal forces were available to retain the stages in alignment and also hold the diffusers in a stationary position.

By contrast, the casing 78 as well as the base 16 and the head 30 of the instant invention cooperate to exert both radial and axial forces on the cartridge 68. As such, it has been found that such cooperation enables the pump assembly 12 to have a somewhat greater usable life than those pumps known in the prior art.

We claim:

1. The method of assembling a pump comprising the steps of:

providing a tubular casing having an inner, cylindrical surface with a diameter of a certain value;

positioning in substantial alignment and externally of said casing a plurality of pump stages in stacked relationship, each of said pump stages presenting a generally cylindrical outer wall having a diameter greater than said diameter of said inner surface of said casing before insertion of said stages in said casing;

placing said stack of pump stages in end-to-end relationship with one end of said casing; and applying sufficient axial pressure to said stack of pump stages to forcibly insert under pressure the entire stack of pump stages in said casing, said axial pressure being of a magnitude sufficient to overcome the interference fit relationship presented between said inner surface of said casing and each of said generally cylindrical outer walls across substantially the entire width of each of the latter, said interference fit relationshsip thereafter causing said casing to maintain said pump stages in compression in directions radially inwardly of said stages in order to retain said stages in alignment and substantially preclude interstage leakage between said casing and said outer wall of each of said stages.

2. The method as set forth in claim 1, including the step of placing a generally cylindrical base having a fluid inlet and a generally cylindrical discharge head in alignment with said stack of pump stages on opposite sides of the latter to enable insertion of said head and said base in said casing during said step of forcibly inserting said stages in said casing.

3. The method as set forth in claim 2, wherein the diameter of said base and said head is larger than the diameter of said casing inner surface before said pump is assembled.

4. The method as set forth in claim 2; including the step of bending opposite outermost end of said casing inwardly around shoulders of said head end and of said base respectively to present roll-formed edges at the outwardmost ends of the remaining, central longitudinal extent of said casing.

5. The method as set forth in claim 4; including the step of pressing said stages between said base and said head during bending of said outermost ends of said casing.

6. The method as set forth in claim 1, wherein said diameter of each of said outer walls of said pump stages is within the range of about 0.33% to about 1.36% larger than the diameter of said casing inner surface before said stages are forcibly inserted in said casing.

* * * * *